United States Patent [19]

Pessina et al.

[11] 4,371,156

[45] Feb. 1, 1983

[54] CENTERING CONVEYOR, PARTICULARLY FOR BOOKBINDERY AND THE LIKE

[76] Inventors: Giorgio Pessina; Aldo Perobelli, both of Via Arborina 2, Paderno Dugnano, (Milano), Italy, 20037

[21] Appl. No.: 197,791

[22] Filed: Oct. 17, 1980

[30] Foreign Application Priority Data

Oct. 17, 1979 [IT] Italy ..... 26556 A/79

[51] Int. Cl.[3] ..... B65H 39/055

[52] U.S. Cl. ..... 270/54; 270/58; 198/644

[58] Field of Search ..... 270/53–58; 271/188, 271; 198/644, 735, 417

[56] References Cited

U.S. PATENT DOCUMENTS

| | | | |
|---|---|---|---|
| 2,711,897 | 6/1955 | Grunlee | 270/54 X |
| 3,104,101 | 9/1963 | Robinow | 271/188 X |
| 3,356,361 | 12/1967 | Geisler | 270/58 |
| 3,381,800 | 5/1968 | Everett | 198/735 |
| 3,556,515 | 1/1971 | Mueller | 271/271 X |
| 4,015,843 | 4/1977 | Tennant | 271/253 X |
| 4,047,712 | 9/1977 | Burkhardt | 198/417 X |

*Primary Examiner*—A. J. Heinz

*Attorney, Agent, or Firm*—Kirschstein, Kirschstein, Ottinger & Cobrin

[57] ABSTRACT

A conveyor for stacks of sheets, pamphlets, or books (7) comprising a work surface (10) formed by two surface halves (12,13), one (13) of which extends in one plane and the other (12) follows a curvilinear pattern interconnecting an input incline with a substantially horizontal output surface. In the slit (11) defined by the two surface halves (12,13) there are inserted entrainers (6) for the books (7) associated with a drive chain. Guiding side boards (14,15) allow a self-centering transfer of the books (7). On the surface halves (12,13), there is provided a mechanism (**12*a*,13*a*) for the friction between the books and surface halves (12,13**) themselves.

6 Claims, 4 Drawing Figures

CENTERING CONVEYOR, PARTICULARLY FOR BOOKBINDERY AND THE LIKE

This invention relates to a centering conveyor, particularly for use in bookbindery and the like fields.

Bookbindery is known to require that stacks of sheets, signatures, and pamphlets—hereinafter termed "books" for brevity—can be transferred, for example, from a collator to a stacker, the delivery end of the former and loading end of the latter being usually located at different heights.

It is current practice to effect such intermediate transfer of books, e.g. from a collator to a stacker, by a separate intermediate conveyor which is oriented perpendicularly proximate to the collator output end. The collator will usually include a closed loop driving chain associated with a drive means and provided with rod-like entraining devices rigidly associated therewith and protruding perpendicularly from the chain. This chain provides the delivery movement of the books from the collator. The books are then brought to a stop at the point of mergence with the intermediate conveyor, the conveyor being operated to move the books away from the collator.

The perpendicular arrangement of the intermediate conveyor reflects in the need of also arranging the stacker perpendicular to the collator.

Obviously, this increases the system space requirements, the space available at bookbinder's, printers, and the like, being as a rule at a premium.

An additional disadvantage of conventional solutions is that synchronization means and members must be provided to time the collator output rate to the conveyor speed.

Furthermore, an even more difficult problem to solve is that of providing a correct alignment or centering of the books being transferred relatively to the entraining peg(s) in the frequently occurring circumstance where the books are to be moved along an upward slope.

This invention sets out to provide an intermediate conveyor of the same general type indicated hereinabove, which can obviate the disadvantages and shortcomings of conventional devices, and affords an accurately self-centered transfer of the sheet stacks, or pamphlets, with respect to the entraining peg(s), that is to say, of the books from the delivering machine, e.g. a collator, to a downstream located machine, e.g. a stacker.

According to one aspect of this invention, there is provided an intermediate centering conveyor, particularly for use in bookbindery and the like applications, comprising a supporting frame, a chain with entraining means and driving means, characterized in that it further comprises the following features:

(a) the work surface is divided by a slit for the passage of the entrainers therethrough into two half-surfaces, one of said surface halves extending substantially along a preferably horizontal plane, whilst the other of said surface halves has a vertically curvilinear configuration interconnecting an incline at the input end of the intermediate conveyor with a substantially horizontal surface, at the output end of the intermediate conveyor or surface coplanar with said one surface half;

(b) said two surface halves include friction attenuating means;

(c) a centering side board is provided on each said surface half;

(d) the side board located on said one surface half extend substantially in one plane and is supported for swinging movement at the input end thereof; and (e) said side boards are provided with means for detachably securing said side boards to the respective ones of said surface halves, or to the structure of the intermediate conveyor, in the form of screw clamps.

Additional improvements and features of this conveyor are pointed out in the appended claims.

With a conveyor of the type provided by this invention, space requirements are reduced, an extremely valuable freature in the bookbinding and allied fields.

Moreover, this intermediate conveyor affords an accurate transfer of the books, in that such transfer is effected on the fly, that is without stopping the books for a more or less prolonged time during the book transfer operation.

Also, the intermediate centering conveyor of this invention has an extremely simple construction and can be advantageously implemented either as an individual unit or as a terminating "extension" of the delivering machine, e.g. a collator. In the latter instance, a substantial added reduction of the conveying means can be achieved because the same transfer chain of the collator is utilized, and speed synchronizing means can be eliminated.

Advantageously, moreover, the intermediate conveyor according to the invention is equipped with means which materially reduce the frictional resistance originated during the book transfer. The intermediate conveyor of this invention is also constructionally simple and easily manufactured.

The invention further provides for the association of the intermediate centering conveyor with the book delivering machines, such as a collator, along a parallel longitudinal axis with respect to the machine longitudinal axis, it being possible to make such axes coincide.

Further features, advantages and details of the intermediate centering conveyor according to this invention will be more clearly apparent from the following exemplary description, with reference to the accompanying drawing, where:

Figure 2:
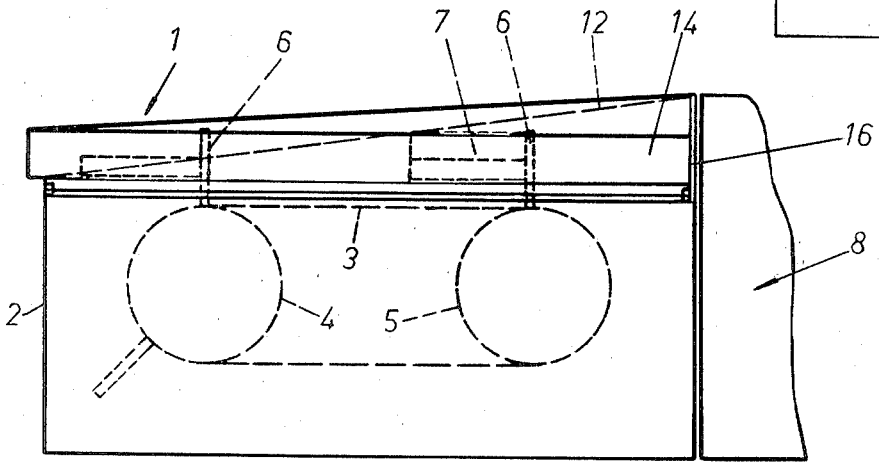
FIG. 2 is a side elevational view of the conveyor shown in FIG. 1.

With reference to the drawing figures, wherein similar parts have been designated with the same reference numerals, the self-centering intermediate conveyor according to this invention is generally indicated at 1. It comprises a frame, or housing, 2, shown schematically, and a conveyor chain 3 passed around two sprocket wheels 4,5, one of which is powered by means known per se and no further discussed herein. The numeral 6 designates peg-type entrainers which are evenly scattered along the chain 3 and firmly associated therewith. The individual sheet stacks, or pamphlets, or individual books, are indicated at 7. The books 7 are assumed to come from an upstream located delivering machine, such as a collator, shown schematically at 8, (FIGS. 2 and 4) at the input end of the intermediate conveyor and to be intended for transfer to a stacker 9, located downstream of the conveyor 1 at the output end thereof.

Figure 4:
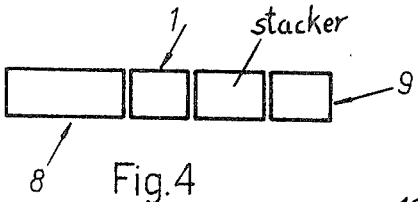
FIG. 4 illustrates diagramatically an associated arrangement of this conveyor.
Figure 1:
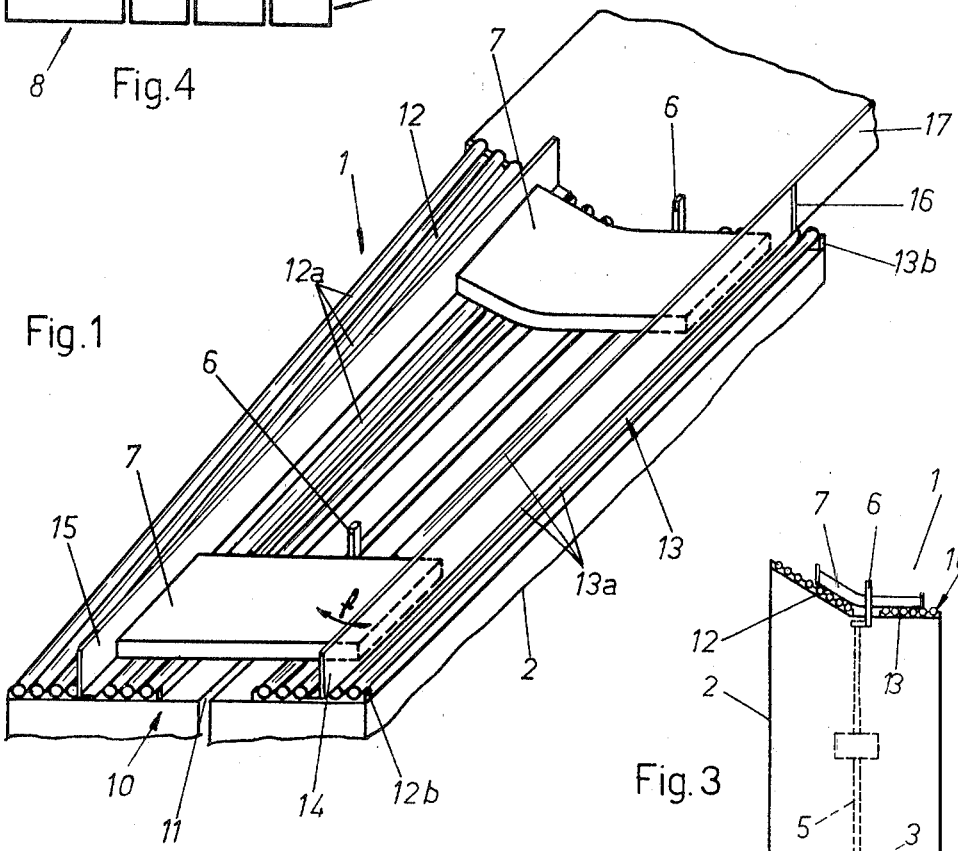
FIG. 1 is a perspective view of the upper portion of an intermediate centering conveyor according to the invention.
Figure 3:
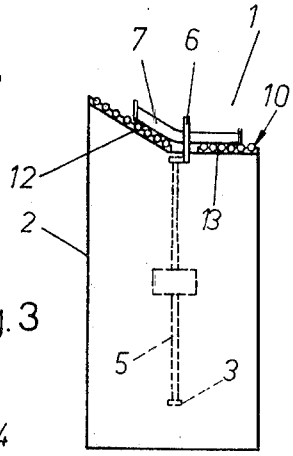
FIG. 3 is a front view of the input end of the conveyor according to the invention.

As clearly visible in FIG. 4, the arrangement including the collator, the new intermediate centering conveyor, and stacker, is a tandem one.

At 10, there is indicated the work surface of the intermediate conveyor 1, which has a longitudinal slit 11 for the passage of the entrainers 6 therethrough, thereby two supporting surface halves 12,13 are defined. In the embodiment illustrated, the surface half 13 extends along one plane, e.g. a horizontal plane, whilst the surface half 12 has on the input side an inclined attitude, the inclination angle being equal to that of the delivery surface of the collator 8; at the output side said surface half 12 extends in a plane which is preferably horizontal and coplanar with that of the surface half 13; the transition from the inclined plane to the hozizontal plane of the surface half 12 is gradual and uniform.

According to the invention, in order to reduce the friction between a book 7, namely the bottom sheet thereof, and the surface halves 12,13, the latter are in the form of a plurality of rod-like elements 12*a*,13*a*, laid side-by-side with intervening slits. The rod-like elements are accommodated in seating heads 12*b*,13*b*. According to the invention, to achieve the desired self-centering of the books 7 during their transfer, there are provided two side boards 14,15 having, in the embodiment shown, an L-like cross-section, and preferably formed from a bent metal sheet. The narrow sides of the "L" rest on the surface halves 12,13, whereas the vertical sides of the "L" define the guiding sidewalls proper. Said side boards 14,15 can be attached in a removable manner to the surface halves 12,13 by means of screw clamps, known per se and not described herein in detail for brevity reasons.

In the embodiment shown, provision is made for hingedly connecting at 16 the side board 14 to the frame of the conveyor 1, and is accordingly swingable in the directions of the double arrowheads f. In the embodiment shown, the side board 14 follows the side board 17 of the collator 8 in alignment relationship therewith.

In the embodiment shown, the intermediate centering conveyor according to the invention is provided in the form of a separate unit. However, it could just as well be provided as an extension of the collator, specifically either as a detachable attachment thereof or as an integral part thereof. In either cases, the chain 3 would be replaced by the chain of the collator 8. In this case, the otherwise necessary means for synchronizing the collator and conveyor speeds would be omitted altogether.

The operation of the intermediate centering conveyor according to the invention will be apparent from the structural description thereof and from the following remarks.

The books 7, as delivered from the collator in a conventional manner, that is by means of the conveyors thereof, not shown, come to engage with the entrainers 6 of the chain 3, and along their transfer path on the intermediate conveyor, are moved from the oblique position on the input end to the horizontal position on the output end, the change of position being determined gradually by the interconnecting surface half 12. Th correct formation of the book is maintained by the side boards 14,15. The friction between the bottom sheet of the books 7 and surface halves 12,13 is reduced to very low values by the use of the rod-like sectional members 12*a*,13*a*. Thus, the full surface area sliding friction is converted into a linear friction. The friction reduction may also be obtained, as is known from other equipment, by utilizing, for example, belts, webs, ropes, solid rollers and/or segmented rollers at least in part powered, an air cushion transport, and the like.

It will be appreciated from the foregoing that this book-centering intermediate conveyor effectively achieves the objects and advantages of the invention, as mentioned hereinabove.

In particular, the books are transferred and centered such that they retain exactly their configuration, because on one side the sliding friction is reduced substantially, and on the other side the books are transferred without undergoing any temporary stopping and with the aid of the positioning side boards. Moreover, the advantage is achieved that a straight line system is obtained, which brings about a somewhat reduced expenditure of space. According to the invention, the signatures, sheets, books or the like are accurately centered with respect to one or more entraining pegs, for a correct and accurate introduction, in alignment, into machines or parts thereof intended for subsequent processing of said books and the like.

In practicing the invention, it will be possible to replace individual parts with technical or functional equivalents thereof, and it will be possible to provide, in a manner known per se, either a work surface 10 having horizontal surface halves, or an overhead chain conveyor, i.e. a conveyor located above the work surface 10, for example, with fork conveyors adapted for engaging the books while they are still engaged by a peg entrainer, or the like, of the collator, and accordingly adapted for transferring the books on the fly, or to replace the cited rod-like sectional members with other, different cross-section members formed at the top with a longitudinal rib, or to provide a chute-like sliding surface with vertically extending ribs, etc., without departing from the scope of this invention.

The intermediate centering conveyor of this invention in addition to being arranged in a substantially horizontal plane, could also be given a sloping set, in which case it would function to establish a direct connection between the collator and stacker. Thus, the need for a conventional inclined interconnecting conveyor would be avoided, such as is instead required with currently employed conveyors of traditional desing, wherein the oncoming books were first stopped, and then diverted along a perpendicular travel path.

The dimensions and materials, as well as the geometrical configuration of the centering side boards may be selected as desired without departing from the instant inventive concept.

All of the characteristics which may be inferred from the foregoing description, appended claims, and accompanying drawings are substantial to this invention, either singly or in any desired combination.

We claim:

1. In a bookbinding machine, an intermediate centering conveyor (1) between a collator and a stacker, said intermediate conveyor engaging books which it moves from the collator to the stacker and constituting:

(A) a supporting frame (2), (B) a chain (3) with entraining means (6) and driving means (4,5) for transferring books in mutually spaced relationship from the collator to the stacker, and (C) a work surface (10) divided by a slit (11) for the passage of the entrainers therethrough into two stationary halfsurfaces (12,13), the improvement comprising:

(D) one of said surface halves (13) extending substantially along a horizontal plane, (E) the other of said surface halves (12) being an elongated continuous surface having a portion inclined relative to said horizontal plane at an input end of the intermediate conveyor and a substantially horizontal surface at the output end of the intermediate conveyor, which hozizontal surface is substantially coplanar with the one surface half (13), a transition portion being continuous with and interconnecting said inclined portion with said horizontal portion, said transition portion providing a surface for gradually and continuously transitioning books conveyed along said surface halves from a partially inclined orientation to a fully planar horizontal position, (F) stationary friction attenuating means (12*a*, 13*a*) forming the upper surfaces of the two surface halves, (G) different elongated side boards (14,15) mounted on each of said surface halves on opposite sides of the slit, for aligning the sheets of the books as the books are conveyed along the surface halves, (H) one of said side boards (14) being located on the horizontal surface half (13) extending in a substantially horizontal direction parallel to the horizontal plane of said horizontal surface half, (I) means connecting the end of the side board (14) at the input end of the intermediate conveyor for swinging movement about a vertical axis, and (J) screw clamps for detachably securing said side boards to their associated halves.

2. The improvement according to claim 1 wherein the side boards are substantially L-shaped in cross-section, with one leg of each L being longer than the other leg, and with the short legs of the L's resting on the side boards and facing one another.

3. The improvement according to claim 1 wherein the said board which has an end supported for swinging movement constitutes an extension of a similar side board on a collator or similar machine.

4. The improvement according to claim 1 wherein the conveyor constitutes the output of a collator or the like machine, the conveyor chain of which is the same chain as the chain of the conveyor.

5. A delivery transfer and stacking tandem line for books which includes the conveyor of claim 1 characterized in that the collator and the intermediate conveyor transfer books leaving the delivery machine at an oblique attitude to a substantially horizontal output attitude at the output end of the intermediate conveyor, and the intermediate conveyor delivers the books in a horizontal attitude to a stacker.

6. The improvement according to claim 1 wherein the chain moves continuously.

* * * * *